US010174391B2

(12) United States Patent
Ferrer

(10) Patent No.: US 10,174,391 B2
(45) Date of Patent: Jan. 8, 2019

(54) CRYOGENIC TREATMENT OF MARTENSITIC STEEL WITH MIXED HARDENING

(75) Inventor: Laurent Ferrer, Lieusaint (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 628 days.

(21) Appl. No.: 13/382,052

(22) PCT Filed: Jul. 2, 2010

(86) PCT No.: PCT/FR2010/051402

§ 371 (c)(1),
(2), (4) Date: Mar. 23, 2012

(87) PCT Pub. No.: WO2011/001126

PCT Pub. Date: Jan. 6, 2011

(65) Prior Publication Data

US 2012/0168039 A1 Jul. 5, 2012

(30) Foreign Application Priority Data

Jul. 3, 2009 (FR) ..... 09 54577

(51) Int. Cl.
*C21D 6/04* (2006.01)
*C21D 9/30* (2006.01)
(Continued)

(52) U.S. Cl.
CPC ..... *C21D 6/04* (2013.01); *C21D 9/30* (2013.01); *C22C 38/06* (2013.01); *C22C 38/44* (2013.01); *C22C 38/52* (2013.01)

(58) Field of Classification Search
CPC ..... C21D 6/00; C21D 11/00; C22C 38/44; C22C 38/52
(Continued)

(56) References Cited

U.S. PATENT DOCUMENTS 5,393,488 A 2/1995 Rhoads et al.
6,238,455 B1 5/2001 Brown et al.
(Continued)

FOREIGN PATENT DOCUMENTS

FR 2 885 141 11/2006
FR 2 887 558 12/2006
(Continued)

OTHER PUBLICATIONS

NPL-1: ASTM E140-97, updated on Jun. 1999.*
(Continued)

*Primary Examiner* — Jie Yang
(74) *Attorney, Agent, or Firm* — Oblon, McClelland, Maier & Neustadt, L.L.P.

(57) ABSTRACT

The invention relates to a method for producing martensitic steel that comprises a content of other metals such that the steel can be hardened by an intermetallic compound and carbide precipitation, with an Al content of between 0.4% and 3%, comprising the following steps:

Figure 1:
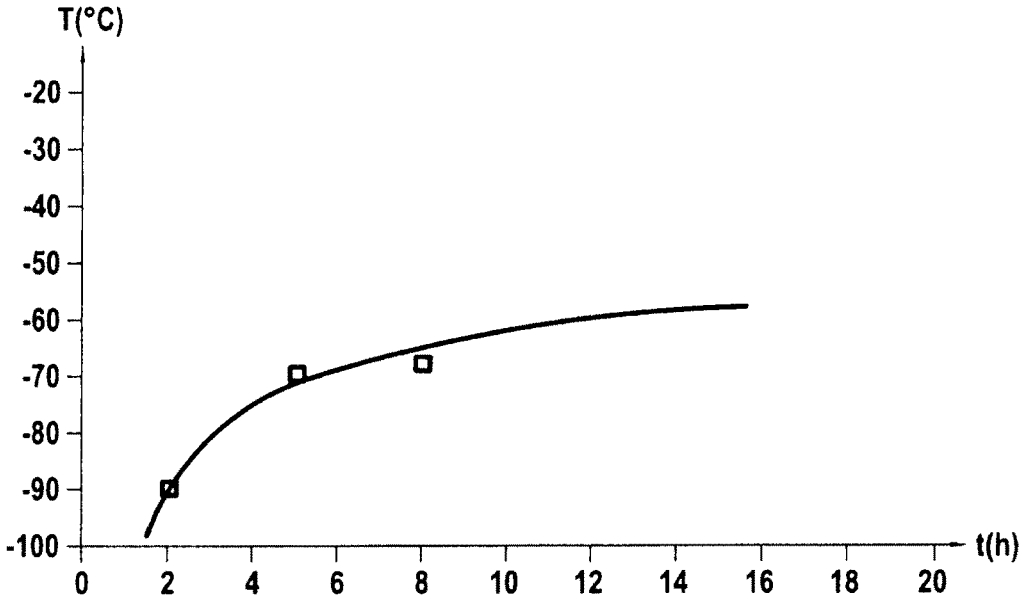

(a) heating the entirety of the steel above its austenizing temperature,
(b) cooling said steel approximately to ambient temperature,
(c) placing said steel in a cryogenic medium.

The temperature $T_1$ is substantially lower than the martensitic transformation temperature Mf, and the time t during which said steel is kept in said cryogenic medium at a temperature $T_1$ from the moment when the hottest part of the steel reaches a temperature lower than the martensitic transformation temperature Mf is at least equal to a non-zero time $t_1$, the temperature $T_1$ (in ° C.) and the time $t_1$ (in hours) being linked by the equation $T_1=f(t_1)$, the first derivative of the function $f$ relative to t, $f'(t)$, being positive, and the second derivative of $f$ relative to t, $f''(t)$, being negative.

18 Claims, 2 Drawing Sheets

(51) Int. Cl.

| | |
|---|---|
| ***C22C 38/06*** | (2006.01) |
| ***C22C 38/44*** | (2006.01) |
| ***C22C 38/52*** | (2006.01) |

(58) Field of Classification Search
USPC ..... 148/320, 503
See application file for complete search history.

(56) References Cited

U.S. PATENT DOCUMENTS

| | | | | |
|---|---|---|---|---|
| 7,475,478 | B2 * | 1/2009 | McCrink ..... | C21D 6/002 148/592 |
| 8,153,056 | B2 * | 4/2012 | Montagnon et al. ..... | 420/83 |
| 2008/0193321 | A1 | 8/2008 | Montagnon et al. | |
| 2009/0229417 | A1 * | 9/2009 | Shepard et al. ..... | 76/101.1 |
| 2010/0139817 | A1 | 6/2010 | Montagnon | |
| 2010/0200119 | A1 | 8/2010 | Montagnon | |

FOREIGN PATENT DOCUMENTS

| | | | |
|---|---|---|---|
| GB | 1 056 561 | | 1/1967 |
| GB | 1 089 934 | | 11/1967 |
| JP | 2004-522859 | A | 7/2004 |
| JP | 2008-539331 | A | 11/2008 |
| JP | 2008-546912 | A | 12/2008 |
| JP | 2011-528068 | A | 11/2011 |
| WO | 01 31076 | | 5/2001 |
| WO | 02 079534 | | 10/2002 |
| WO | WO 2006/114499 | A2 | 11/2006 |
| WO | WO 2007/003748 | A1 | 1/2007 |
| WO | 2009 007562 | | 1/2009 |
| WO | WO 2010/007297 | A1 | 1/2010 |

OTHER PUBLICATIONS

Office Action dated Mar. 11, 2014, in Japanese Patent Application No. 2012-518125 (submitting English translation only).
U.S. Appl. No. 13/501,610, filed Apr. 12, 2012, Ferrer, et al.
U.S. Appl. No. 13/501,377, filed Apr. 11, 2012, Ferrer, et al.
U.S. Appl. No. 13/501,568, filed Apr. 12, 2012, Ferrer, et al.
Garrison Jr., W. M., et al., "An Evaluation of an Ultra-High Strength Steel Strengthened by Alloy Carbide and Intermetallic Precipitates," Transactions of the Indian Institute of Metals, vol. 49, No. 3, pp. 151-162, (Jun. 1, 1996) XP002050456.
International Search Report dated Sep. 16, 2010 in PCT/FR10/051402 Filed Jul. 2, 2010.
U.S. Appl. No. 13/382,045, filed Feb. 1, 2012, Ferrer, et al.
Canadian Office Action dated Jun. 5, 2017 in corr. Canadian Patent Application No. 2,766,788 (w/ partial English translation).
Ansell et al., "The Effect of Quench Rate on the Martensitic Transformation in Fe—C Alloys", Metallurgical Transactions, vol. 2, Sep. 1971, pp. 2443-2444.
'Quench hardening of steel', in Total Materia: The world's most comprehensive materials database [online database], Nov. 2000. Retrieved from the Internet: <URL: http://totalmateria.com/articles/Art12.htm>.

* cited by examiner

CRYOGENIC TREATMENT OF MARTENSITIC STEEL WITH MIXED HARDENING

The present invention relates to a method for producing martensitic steel that comprises a content of other metals such that the steel can be hardened by an intermetallic compound and carbide precipitation, with Al content of between 0.4% and 3%, and with a martensitic transformation temperature Mf below 0° C., this thermal treatment method comprising the following steps:

(a) heating the entirety of the steel above the austenizing temperature AC3thereof, (b) cooling said steel to around the ambient temperature, (c) placing said steel into a cryogenic medium at a temperature $T_1$.

For certain applications, in particular for turbomachine transmission shafts, it is necessary to use such steels, which have a very high mechanical strength (yield strength and breaking load) up to 400° C. and at the same time good resistance to brittle fracture (high stiffness and ductility). These steels have good fatigue behavior.

The composition of such a steel is given in document FR 2,885,142 as follows (percentages by weight): 0.18 to 0.3% of C, 5 to 7% of Co, 2 to 5% of Cr, 1 to 2% of Al, 1 to 4% of Mo+W/2, traces to 0.3% of V, traces to 0.1% of Nb, traces to 50 ppm of B, 10.5 to 15% of Ni with Ni≥7+3.5 Al, traces to 0.4% of Si, traces to 0.4% of Mn, traces to 500 ppm of Ca, traces to 500 ppm of rare earths, traces to 500 ppm of Ti, traces to 50 ppm of O (development from molten metal) or to 200 ppm of O (development through powder metallurgy), traces to 100 ppm of N, traces to 50 ppm of S, traces to 1% of Cu, traces to 200 ppm of P, the rest being Fe.

This steel has a very high mechanical strength (breaking load able to go from 2000 to 2500 Mpa) and at the same time very good resilience ($180 \cdot 10^3$ J/m$^2$) and toughness (40 to 60 MPa$\cdot\sqrt{m}$), and good fatigue behavior.

These mechanical properties are obtained owing to the thermal treatments to which the steel is subjected. In particular, the steel undergoes the following treatment: the steel is heated and kept above its austenizing temperature AC3 until its temperature is substantially homogenous, the steel is then cooled to approximately ambient temperature, then the steel is placed and kept in an enclosure where cryogenic temperature reigns. "Cryogenic" refers to temperatures below 0° C.

The purpose of placing such steels in a cryogenic enclosure is to minimize the remaining austenite content in the steel, i.e. to optimize the transformation of austenite into martensite in the steel. In fact, the mechanical strength properties of the steel increase inversely to its austenite content. For the steels covered by this application, the martensitic transformation temperature Mf is comprised between −30° C. and −40° C. estimated under thermodynamic equilibrium conditions. To ensure an optimal transformation of the austenite into martensite, it is generally considered that the temperature in the cryogenic enclosure must therefore be slightly below the temperature Mf. Thus, given the impervious nature of the transformation of austenite into martensite, it is allowed that the temperature in the cryogenic enclosure must be below −40° C., and that the optimal transformation into martensite occurs when the hottest parts of the steel have reached that temperature. The steel is then removed from the cryogenic enclosure.

However, the results of mechanical hardness and tension tests conducted on this steel after such a cryogenic treatment show great dispersion in the mechanical properties of the steel, which is undesirable. Furthermore, these results do not follow a normal statistical law in light of the cryogenic treatment parameters, conversely the results are distributed according to a sum of a multitude of normal laws according to the thermal treatment conditions, and in particular the passage into cryogenic medium. This intermodal behavior further emphasizes the calculated dispersion (when one covers all of these results in a same family) and lowers the value of the average. The minimums (calculated to three standard deviations below the average) of the sizing curves are then still further lowered.

The present invention aims to resolve these drawbacks.

The invention aims to propose a steel treatment method of this type that makes it possible to reduce the dispersions in its mechanical properties, yields dispersions that follow normal statistical laws, and increases these mechanical properties on average.

This aim is achieved owing to the fact that the temperature $T_1$ is substantially lower than the martensitic transformation temperature Mf, and the time t for keeping said steel in said cryogenic medium, at a temperature $T_1$ from the moment when the hottest portion of the steel reaches a temperature lower than the martensitic transformation temperature Mf, is at least equal to a non-zero time $t_1$.

Owing to these provisions, all of the austenite that may potentially be transformed into martensite in the steel as it is introduced into the cryogenic medium is optimally transformed. An optimal transformation means that the remaining austenite content in the steel is minimal in all of the steel. The dispersion of the values of the mechanical properties is therefore decreased, since the austenite content is homogenous in all of the steel. Furthermore, these values are increased on average, since the austenite content in the steel is minimized.

For example, the temperature $T_1$ (in ° C. with a tolerance of +/−5° C.) and the time $t_1$ (in hours with a tolerance of +/−5%) are substantially linked by the equation $$T_1=f(t_1) \text{ with } f(t)=57.666\times(1-1/(t^{0.3}-0.14)^{1.5})-97.389.$$

Advantageously, the steel is placed in the cryogenic medium less than 70 hours after the moment when the temperature on the surface of the piece, during cooling thereof in step (b), reaches the temperature of 80° C.

In this way, the maximum rate of transformation of austenite into martensite that can be expected in the steel through its placement in a cryogenic medium is as high as possible.

Figure 2:
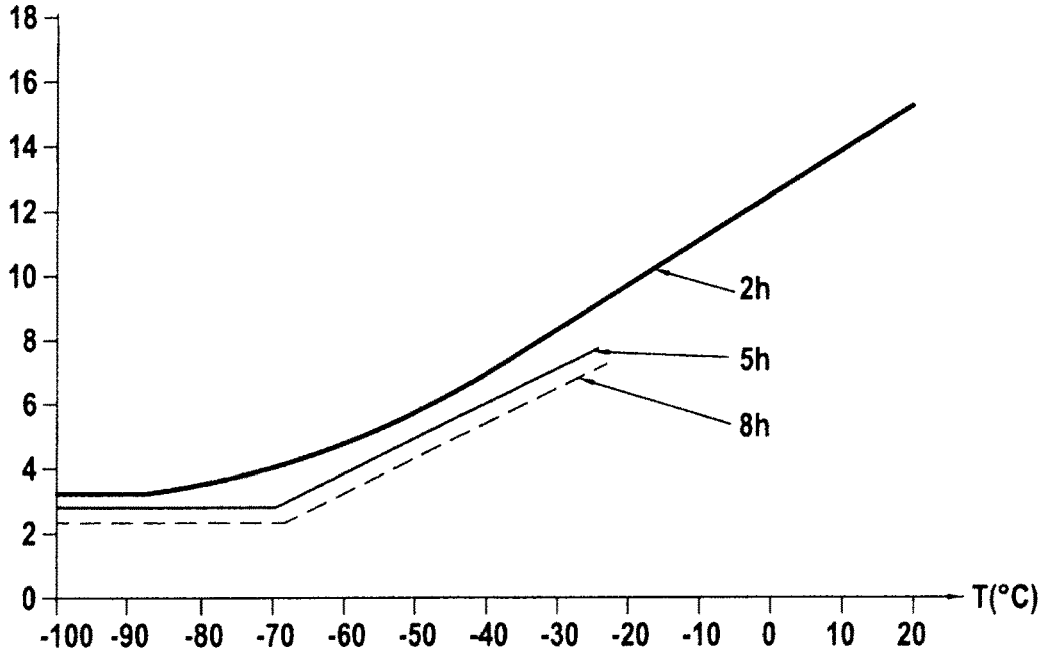
Figure 3:
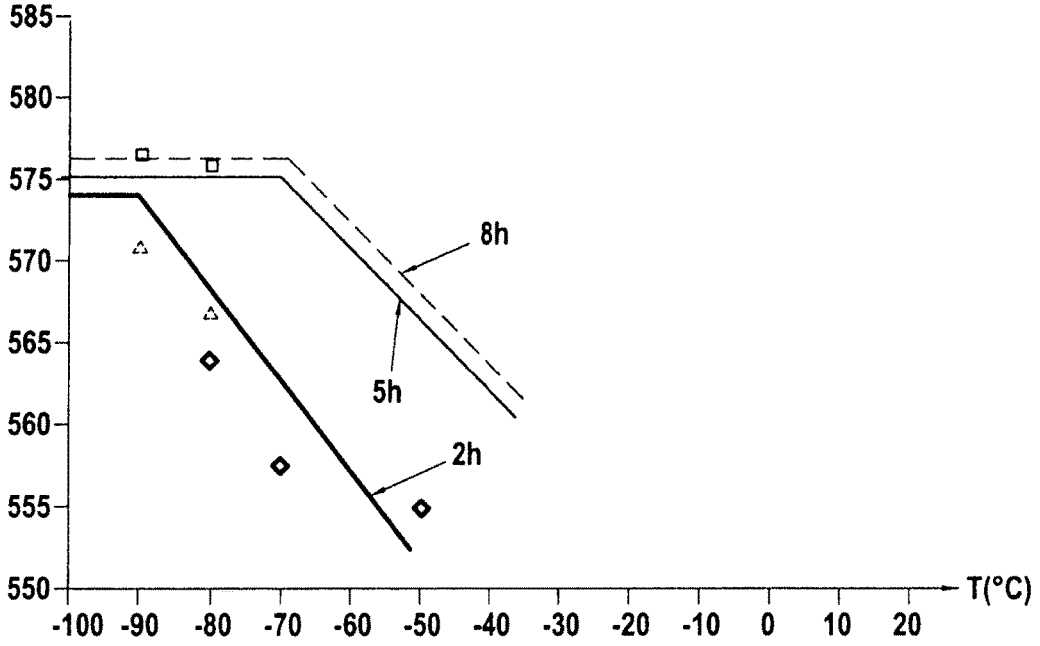
Figure 4:
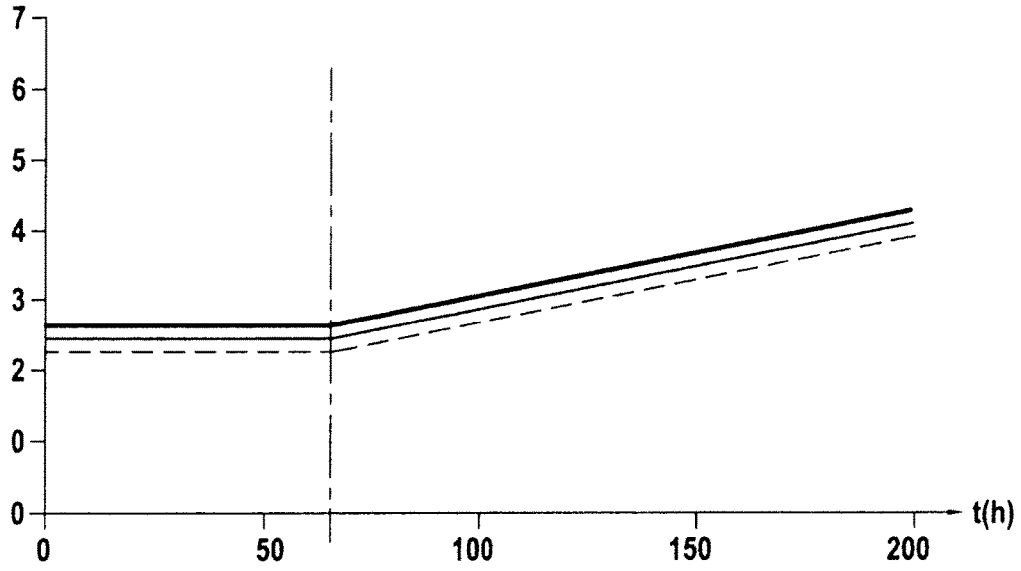

The invention will be well understood and its advantages will better appear upon reading the following detailed description, of an embodiment shown as a non-limiting example. The description refers to the appended drawings, in which:

FIG. 1 shows the equation $T_1=f(t_1)$ between the time $t_1$ during which the steel is kept in the cryogenic enclosure after the hottest portion of the steel reaches a temperature lower than the martensitic transformation temperature Mf, and the temperature $T_1$ in the enclosure, in the method according to the invention, FIG. 2 shows the variation of the level of austenite remaining in a steel as a function of the temperature $T_1$ in the cryogenic enclosure for different times $t_1$ during which the steel is kept in that enclosure after the hottest portion of the steel reaches a temperature lower than the martensitic transformation temperature Mf, FIG. 3 shows the variation of the hardness in a steel as a function of the temperature $T_1$ in the cryogenic enclosure for different times $t_1$ during which the steel is kept in that enclosure after the hottest portion of the steel has reached a temperature lower than the martensitic transformation temperature Mf, FIG. 4 shows the variation of the level of austenite remaining in the steel as a function of the period separating the end of cooling of that steel from its austenizing temperature, and the placement of said steel in the cryogenic enclosure, for different times $t_1$ during which the steel is kept in that enclosure after the hottest portion of the steel reaches a temperature lower than the martensitic transformation temperature Mf.

As indicated in the preamble, a steel covered by the present application is subject to the following treatment, with the aim of minimizing its residual austenite content: this steel is heated and kept above its austenizing temperature until its temperature is substantially homogenous, the steel is then cooled to around the ambient temperature, then the steel is placed and kept in an enclosure where a cryogenic temperature prevails.

The inventors have performed tests on such steels having undergone the above treatment. These steels have the following composition: 0.200% to 0.250% in C, 12.00% to 14.00% in Ni, 5.00% to 7.00% in Co, 2.5% to 4.00% in Cr, 1.30 to 1.70% in Al, 1.00% to 2.00% in Mo.

FIG. 2 shows, according to the results of these tests, the variation of the level of austenite remaining in a steel as a function of the temperature $T_1$ in the cryogenic enclosure for different lengths of time $t_1$, where $t_1$ is the time during which said steel is kept in said cryogenic enclosure after the hottest portion of the steel reaches a temperature lower than the martensitic transformation temperature Mf.

These results show that if the steel is kept in the enclosure for two hours after the hottest portion of the steel reaches a temperature lower than the martensitic transformation temperature Mf, it is necessary for the temperature of the enclosure to be lower than or equal to −90° C. for the residual austenite level to be minimal. Above that temperature, the residual austenite level is higher. Below −90° C., the residual austenite level remains substantially constant and equal to its minimum value, in this case approximately 2.5% (measurement taking into account the natural dispersion of the measurement).

Similarly, if the steel is kept in the enclosure for 5 hours or 8 hours after the hottest portion of the steel reaches a temperature lower than the martensitic transformation temperature Mf, it is necessary for the temperature of the enclosure to be equal to or lower than approximately −71° C. and −67° C., respectively, for the residual austenite level to be minimal.

The results show that in all cases, the residual austenite level is substantially equal.

More generally, the residual austenite content is minimal and substantially constant when the time $t_1$ and the temperature $T_1$ are situated under the curve $T_1 = f(t1)$ given in FIG. 1.

The equation of this curve is:

$$f(t) = 57.666 \times \left(1 - \frac{1}{(t^{0.3} - 0.14)^{1.5}}\right) - 97.389$$

The curve $T_1 = f(t_1)$ gives the temperature $T_1$ (expressed in ° C.) in the cryogenic chamber where the steel must be kept for a period of time $t_1$ (expressed in hours) after the hottest portion of the steel reaches a temperature lower than the martensitic transformation temperature Mf so that all regions of the steel are maximally transformed into martensite, and therefore have a minimal and homogenous residual austenite content.

The curve $T_1 = f(t_1)$ is obtained through statistical approximation of the experimental results given in table 1 below. It is therefore understood that for a given time $t_1$ for keeping the steel in the cryogenic chamber after the hottest portion of the steel reaches a temperature lower than the martensitic transformation temperature Mf, the temperature in that chamber must be approximately equal to or lower than that given by the curve $T_1 = f(t_1)$. The first derivative of the function f relative to t, $f'(t)$, is positive, and the second derivative of $f$ relative to t, $f''(t)$, is negative.

The appearance of this curve is valid for all steels in this family and translates in the vertical direction (temperature variation) as a function of the chemical composition of the steel. The horizontal asymptote of this equation (the temperature $T_1$ for which an infinite maintenance time $t_1$ is necessary, i.e. the highest possible temperature for the enclosure) depends on the chemical composition of the steel (this composition directly influences the start Ms and end Mf martensitic transformation temperatures). For the steel in question, this temperature is approximately equal to −40° C. The minimum maintenance time $t_1$ necessary is approximately equal to 1 hour, and is substantially constant for all steels in this family.

TABLE 1

| Time $t_1$ (hours) | Temperature $T_1$ (° C.) |
|---|---|
| 2 | −90 |
| 5 | −70 |
| 8 | −68 |

It will be noted that, unexpectedly, these temperatures $T_1$ are much lower than the temperature of −40° C. commonly allowed as enabling optimal transformation of the austenite into martensite, and that the maintenance time $t_1$ is not zero. Thus, the inventors have shown that it is not sufficient for the hottest portions of the steel to have reached the temperature Mf (or a slightly lower temperature) for the transformation of those portions into martensite to be optimal, but rather that it is also necessary for those hottest portions to be kept in the cryogenic chamber (where a temperature $T_1$ reigns) after they reach a temperature lower than the martensitic transformation temperature Mf for a period at least equal to $t_1$.

FIG. 3 shows, according to the results of other tests conducted by the inventors, the variation in the hardness of such a steel as a function of the temperature $T_1$ in the cryogenic enclosure for the different durations $t_1$, where $t_1$ is the length of time during which said steel is kept in said cryogenic enclosure after the hottest portion of the steel reaches a temperature lower than the martensitic transformation temperature Mf.

These results show that the hardness is maximal and substantially constant when the time $t_1$ and the temperature $T_1$ are situated below the curve $T_1 = f(t_1)$ given in FIG. 1.

By comparing the curves of FIGS. 2 and 3, it is therefore possible to establish a correlation between the residual austenite level in the steel and the hardness of that steel. It can be concluded from this that the lower the austenite content in the steel, the higher the hardness of the steel. The results of tests conducted by the inventors on other mechanical properties show a similar trend, i.e. the mechanical properties increase as the austenite level decreases.

Owing to the method according to the invention, the austenite content in the steel is minimized, and the mechanical properties of the steel are consequently increased on average.

Furthermore, the minimal austenite content in a region of a steel part is only reached when that region has reached a temperature lower than the temperature Mf and is kept there long enough, as shown by the curve of FIG. 1.

In the event that, after the hottest portion of the steel reaches a temperature lower than the martensitic transformation temperature Mf, the piece is kept in the cryogenic enclosure where a temperature $T_1$ reigns for a time t shorter than time $t_1$ satisfying the equation $T_1=f(t_1)$, then certain more central regions of the piece have not stayed below the temperature Mf long enough, while certain regions situated more on the surface of the piece have stayed at temperature Mf long enough. The residual austenite level therefore increases from those surface regions toward said central regions. This spatial variation of the residual austenite level causes a dispersion of the values of the mechanical properties obtained during tests.

However, in the method according to the invention, the steel is kept in the cryogenic enclosure long enough after the hottest part of the steel reaches a temperature lower than the martensitic transformation temperature Mf, which ensures an optimal transformation of that portion into martensite. It will therefore be understood why, owing to the method according to the invention, which makes it possible to obtain a residual austenite level in the steel that is homogenous and minimal, the dispersion of the mechanical property values is minimized, as seen by the inventors. For example, by applying a treatment method according to the prior art, the average hardness of the treated steel is 560 Hv with a statistical minimum of 535 Hv and maximum of 579 Hv. By using the method according to the invention, the average hardness of the treated steel is 575 Hv with a statistical minimum of 570 Hv and maximum of 579 Hv.

Before the steel is placed in the cryogenic enclosure, it undergoes, in step (b), quenching in a fluid (a medium) so as to cool the steel to the ambient temperature. Ideally, this fluid has a drasticity at least equal to that of the air. For example, the fluid is air.

The drasticity of a quenching medium refers to the capacity of that medium to absorb the calories in the closest layers of the piece submerged therein, and to diffuse them into the rest of the medium. This capacity conditions the cooling speed of the surface of the piece submerged in said medium.

The tests conducted by the inventors show that the steel must ideally be placed in the cryogenic medium less than 70 hours after the moment when the surface temperature of the piece during cooling thereof in step (b) reaches the temperature of 80° C.

FIG. 4 shows the results of these tests. When the steel is placed in the cryogenic medium (enclosure) 70 hours or less after the moment when the surface temperature of the piece during the cooling thereof in step (b) reaches the temperature of 80° C., then the residual austenite content in the steel can reach its minimum after being kept in the cryogenic enclosure according to the conditions of the invention. When the steel is placed in the cryogenic medium more than 70 hours after that moment, however, then the residual austenite content cannot reach its minimum, irrespective of the subsequent maintenance period and temperature in the cryogenic enclosure.

The minimum of the residual austenite content is in the vicinity of 2.5% for the steel grade tested in these tests. More generally, for the type of steels according to the invention, the minimum residual austenite content is less than 3%.

For other families of steel, the minimum time $t_1$ values vary. For example, the time $t_1$ may be greater than 2 hours, or greater than 3 hours, or greater than 4 hours.

For each of these times $t_1$, the temperature $T_1$ below which the temperature of the enclosure must be is for example equal to −50° C., or −60° C., or −70° C.

The invention also relates to a piece made from a steel obtained according to a method according to the invention, the residual austenite level in that steel being less than 3%.

For example, the piece may be a turbomachine shaft.

The invention claimed is:

1. A method for producing a martensitic steel, the method comprising:

(a) heating a steel to a first temperature above an austenizing temperature thereof, (b) subsequently cooling the steel to a second temperature equal to an ambient temperature, and (c) subsequently placing and keeping the steel in a cryogenic medium at a third temperature $T_1$ for a period of time t greater than a time $t_1$ and less than 5 hours, wherein the third temperature $T_1$ is less than a martensitic transformation end temperature $M_f$ of the steel, which is below 0° C., the period of time t in (c) is determined from a moment when an internal portion of the steel having a highest temperature following said cooling (b) reaches a temperature lower than $M_f$, the third temperature $T_1$ in ° C. with a tolerance of +/− 5° C. and the time $t_1$ in hours with a tolerance of +/− 5% are related according to an equation $T_1=f(t_1)$, where the function $f$ is given by $$f(t)=57.666\times(1-1/(t^{0.3}-0.14)^{1.5})-97.389$$

or by a temperature-translated curve relative to $f(t)$, and the steel comprises Al in a content of from 0.4 wt % to 3 wt % and is capable of being hardened by an intermetallic compound and carbide precipitation.

2. The method of claim 1, wherein the steel consists of:

0. 18 to 0.3 wt % of C,
5to 7 wt % of Co,
2to 5 wt % of Cr,
1to 2 wt % of Al,
1to 4 wt % of Mo+W/2,
traces to 0.3 wt % of V,
traces to 0.1 wt % of Nb,
traces to 50 ppm of B,
10.5 to 15 wt % of Ni with Ni ≥7+3.5 Al,
traces to 0.4 wt % of Si,
traces to 0.4 wt % of Mn,
traces to 500 ppm of Ca,
traces to 500 ppm of at least one rare earth metal,
traces to 500 ppm of Ti,
traces to 50 ppm of O if developed from molten metal or to 200 ppm of O if developed through powder metallurgy,
traces to 100 ppm of N,
traces to 50 ppm of S,
traces to 1 wt % of Cu,
traces to 200 ppm of P, and
a remainder of Fe.

3. The method of claim 2, wherein
a content of C is from 0.200 wt % to 0.250 wt %,
a content of Ni is from 12.00 wt % to 14.00 wt %,
a content of Co is from 5.00 wt % to 7.00 wt %,
a content of Cr is from 2.5 wt % to 4.00 wt %,
a content of Al is from 1.30 wt % to 1.70 wt %, and
a content of Mo is from 1.00 wt % to 2.00 wt %.

4. The method of claim 1, wherein the time $t_1$ is at least 1 hour.

5. The method of claim 1, wherein said cooling (b) comprises quenching the steel in a medium with a drasticity of at least a drasticity of air.

6. The method of claim 1, wherein (c) starts less than 70 hours after a surface temperature of the steel reaches 80° C.

7. A piece made from a martensitic steel obtained by the method of claim 1, wherein a residual austenite level in the martensitic steel is less than 3wt %.

8. A turbomachine transmission shaft made from a martensitic steel obtained by the method of claim 1, wherein a residual austenite level in the martensitic steel is less than 3 wt %.

9. A martensitic steel obtained by the method of claim 1, wherein an average hardness of the martensitic steel is 575 Hv with a statistical minimum of 570 Hv and maximum of 579 Hv.

10. The method of claim 1, wherein $t_1$ is greater than 2 hours.

11. The method of claim 1, wherein $t_1$ is greater than 3 hours.

12. The method of claim 1, wherein $t_1$ is greater than 4 hours.

13. The method of claim 1, wherein a residual austenite level in the martensitic steel is less than 3 wt %.

14. The method of claim 1, wherein a residual austenite level in the internal portion of the martensitic steel is less than 3 wt %.

15. The method of claim 14,
wherein the martensitic steel has an average hardness of 575 Hv with a statistical minimum of 570 Hv and maximum of 579 Hv.

16. The method of claim 1, wherein an average hardness of the martensitic steel is 575 Hv with a statistical minimum of 570 Hv and maximum of 579 Hv.

17. The method of claim 1, wherein the internal portion of the steel during (c) is a central region of the steel.

18. The method of claim 17, wherein after the internal portion of the steel reaches a temperature lower than $M_f$ and before the time $t_i$, a residual austenite level increases from a surface region to the internal portion.

* * * * *